US006257325B1

(12) United States Patent
Watanabe et al.

(10) Patent No.: US 6,257,325 B1
(45) Date of Patent: Jul. 10, 2001

(54) HEAT EXCHANGER

(75) Inventors: Akimichi Watanabe, Maebashi; Kazuki Hosoya, Sawa-gun, both of (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/421,391

(22) Filed: Oct. 20, 1999

(30) Foreign Application Priority Data

Oct. 23, 1998 (JP) ..... 10-302824

(51) Int. Cl.[7] ..... F28D 1/03; F28F 9/02
(52) U.S. Cl. ..... 165/153; 165/175; 165/176
(58) Field of Search ..... 165/153, 175, 165/176; 62/515

(56) References Cited

U.S. PATENT DOCUMENTS 5,042,577 * 8/1991 Suzumura ..... 165/153
5,511,611 * 4/1996 Nishishita ..... 165/153
5,826,648 * 10/1998 Shimoya et al. ..... 165/153

* cited by examiner

*Primary Examiner*—Leonard Leo
(74) *Attorney, Agent, or Firm*—Baker Botts, L.L.P.

(57) ABSTRACT

A heat exchanger includes a heat exchanger body having a heat exchanger core and header tanks, and a side tank provided at a side of the heat exchanger body for forming fluid introduction/discharge paths. The side tank comprises a first side tank forming plate provided at a heat exchanger body side, and a second side tank forming plate provided at an opposite side. At least one of the first and second side tank forming plates is divided into two parts in a thickness direction of the heat exchanger core. Drawn projecting portions for forming fluid paths from the side tank to the header tanks, and protruding portions for forming the fluid introduction/discharge paths in the side tank, may be formed without generation of cracks or too thin portions when the side tank forming. plates are processed. Consequently, a side tank having a desired structure may be formed, thereby achieving a high-performance heat exchanger.

8 Claims, 12 Drawing Sheets

HEAT EXCHANGER

BACKGROUND OF THE INVENTION

1. Field of the Invention

The present invention relates to a heat exchanger suitable for use in vehicles, and, more particularly, to an improved structure of a heat exchanger having a side tank at a side of a heat exchanger body formed with a heat exchanger core and header tanks.

2. Description of the Related Art

A multi-flow type heat exchanger, for example, used as a condenser or as an evaporator for an air conditioner in vehicles, may be equipped with a side tank at a side of a heat exchanger body. An example of a side tank portion of such a heat exchanger is depicted in FIGS. 9 and 10. Heat exchanger 50 is constructed as a stacking type multi-flow heat exchanger, that has heat transfer tubes 51 and fins 52 alternately disposed. Side plate 53 is provided on the outer side of the outermost fin 52. Side tank 54 is provided on the outer side of side plate 53 for forming fluid introduction/discharge paths 71 and 72.

Side tank 54 comprises a first side tank forming plate 55 provided at a side of heat exchanger body 57, and a second side tank forming plate 56 provided at a non-heat exchanger body side. First and second side tank forming plates 55 and 56 are connected to each other for forming side tank 54. In this structure, first side tank forming plate 55 is formed and processed from a single plate. Drawn projecting portions 58, 59, 60 and 61 are provided integrally with first side tank forming plate 55, and are formed by drawing. Drawn projecting portions 58, 59, 60 and 61 project toward heat exchanger body 57 for forming fluid paths communicating between the interior of side tank 54 and the interior of heat exchanger body 57. On second side tank forming plate 56, protruding portions 62 and 63, which protrude in a direction opposite to the first side tank forming plate side, are provided for forming fluid introduction/discharge paths 71 and 72 in side tank 54. Protruding portions 62 and 63 are formed integrally with second side tank forming plate 56, and extend in the longitudinal direction of second side tank forming plate 56.

In order to enlarge the cross-sectional area of fluid introduction/discharge paths 71 and 72, as depicted in FIGS. 11 and 12, protruding portions 64 and 65 also may be formed on first side tank forming plate 55. A pressure loss in a side tank may be reduced by such enlarged fluid introduction/discharge paths.

In the above-described structure, however, drawn projecting portions 58, 59, 60 and 61 are formed on first side tank forming plate 55, and protruding portions 64 and 65 are also formed on first side tank forming plate 55. Therefore, in portions 66 and 67, which are positioned between protruding portions 64 and 65, and near drawn projecting portions 58, 59, 60 and 61, shown in FIG. 11, the total amount of drawing may be great. The great amount of drawing may cause the generation of cracks on portions 66 and 67, or it may cause an extremely thin portion, resulting in a reduction of strength. Such defects are liable to occur, particularly when projecting portions 58, 59, 60 and 61 are formed by drawing. Further, during the formation of protruding portions 62 and 63 on second side tank forming plate 56, similar such defects may also occur.

SUMMARY OF THE INVENTION

Accordingly, it is an object of the present invention to provide an improved structure of a side tank and vicinity thereof of a side tank type heat exchanger which may prevent the generation of cracks and too thin portions on a plate forming the side tank when forming desired fluid paths in the side tank, thereby achieving a heat exchanger having a less pressure loss in the side tank and having an excellent performance without leakage.

To achieve the foregoing and other objects, the structure of a heat exchanger according to the present invention is herein provided. The heat exchanger includes a heat exchanger body having a heat exchanger core and header tanks, and a side tank provided at a side of the heat exchanger body for forming fluid introduction/discharge paths communicating with the header tanks. The side tank comprises a first side tank forming plate provided at a heat exchanger body side of the side tank, and a second side tank forming plate provided at a non-heat exchanger body side of the side tank. The first and second side tank forming plates are connected to each other for forming the side tank. At least one of the first and second side tank forming plates is divided into two parts in a thickness direction of the heat exchanger core.

In the heat exchanger, the first side tank forming plate may be divided into two parts. On the first side tank forming plate, at least one drawn projecting portion, projecting toward one of the header tanks, may be provided for forming a fluid path communicating between one of the fluid introduction/discharge paths and one of the header tanks. The drawn projecting portion may be connected directly to one of the header tanks. Alternatively, the drawn projecting portion may be connected to one of the header tanks via an auxiliary connecting member. The fluid introduction/discharge paths may extend in the side tank in a longitudinal direction of the side tank. Further, a protruding portion may be formed on the first side tank forming plate for forming at least one of the fluid introduction/discharge paths. The protruding portion may protrude toward the heat exchanger body, and may extend in a longitudinal direction of the first side tank forming plate. The second side tank forming plate also may be divided into two parts.

Alternatively, a heat exchanger according to the present invention may be constructed as follows. The heat exchanger includes a heat exchanger body having a heat exchanger core and header tanks, and a side tank provided at a side of the heat exchanger body for forming fluid introduction/discharge paths communicating with the header tanks. The side tank comprises a first side tank forming plate provided at a heat exchanger body side of the side tank, and a second side tank forming plate provided at a non-heat exchanger body side of the side tank. The first and second side tank forming plates may be connected to each other for forming the side tank. The first side tank forming plate has at least one drawn portion projecting toward one of the header tanks for forming a fluid path communicating between one of the fluid introduction/discharge paths and one of the header tanks. The first side tank forming plate has a slot provided at a central portion of the first side tank forming plate in a thickness direction of the heat exchanger core positioned near the drawn projecting portion.

In this structure, the slot may extend in a longitudinal direction of the first side tank forming plate.

In the heat exchanger, in which at least one of the first and second side tank forming plates is divided into two parts in the thickness direction of the heat exchanger core, even if a protruding portion forming a fluid introduction or discharge path is formed on the divided first or second side tank forming plate, or even if a drawn projecting portion is formed on the divided first side tank forming plate, or both, a forming force may be prevented from being concentrated at a particular portion, as in a conventional structure forming the plate from a single plate. Therefore, defects, such as cracks or too thin portions, are not generated by the forming force at any portion of the divided plate. Consequently, the protruding portion or the drawn projecting portion, or both, may be processed into a desired form without generating any defect. By the desired forms of the protruding portion and the drawn projecting portion without any inconvenience, the fluid path in the side tank may be enlarged, thereby reducing the pressure loss in the side tank, and an excellent performance of the heat exchanger may be achieved without leakage.

In the heat exchanger, in which a slot is provided at a central portion of the first side tank forming plate in a thickness direction of the heat exchanger core at a position near the drawn projecting portion, the force, forming the drawn projecting portion and transmitted along the plate, may be released at the slot. Therefore, an excessive force may be prevented from being generated at the central portion of the first side tank forming plate. Consequently, the protruding portion or the drawn projecting portion, or both, may be processed into a desired form on the first side tank forming plate without generating any defect, such as cracks. By the desired forms of the protruding portion and the drawn projecting portion without any inconvenience, the fluid path in the side tank may be enlarged, thereby reducing the pressure loss in the side tank, and an excellent performance of the heat exchanger may be achieved without leakage.

Further objects, features, and advantages of the present invention will be understood from the following detailed description of the preferred embodiments of the present invention with reference to the accompanying figures.

BRIEF DESCRIPTION OF THE DRAWINGS

Embodiments of the invention are now described with reference to the accompanying figures, which are given by way of example only, and are not intended to limit the present invention.

DETAILED DESCRIPTION OF PREFERRED EMBODIMENTS

Figure 1:
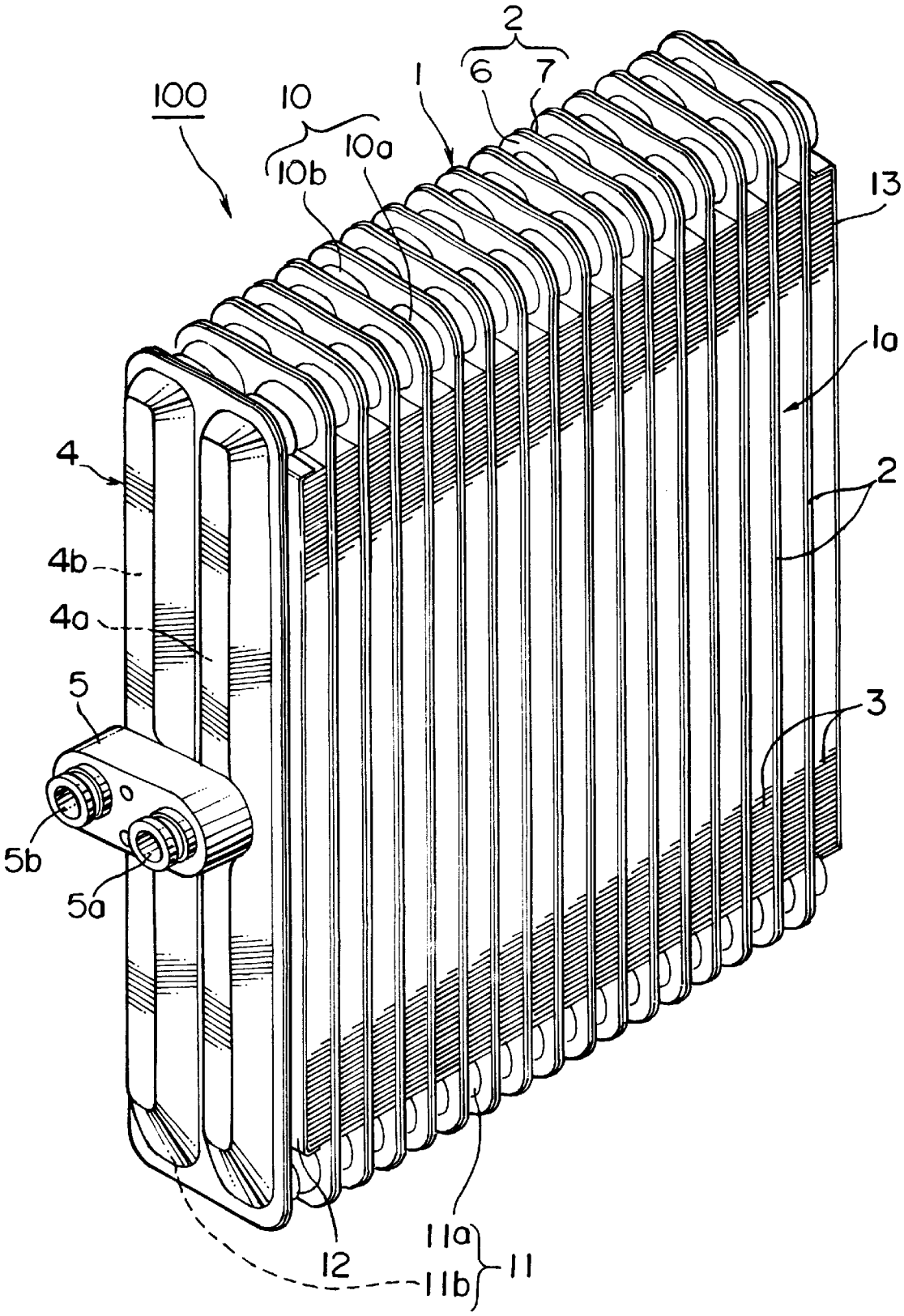
FIG. 1 is a perspective view of a heat exchanger according to a first embodiment of the present invention.

Referring to FIGS. 1 to 4, a heat exchanger of the present invention is provided according to a first embodiment. Heat exchanger 100 is constructed as a stacking type multi-flow heat exchanger. Heat exchanger 100 includes heat exchanger body 1, that has heat transfer tubes 2 and fins 3 alternately disposed. Side plates 12 and 13 are provided on the respective outer surfaces of both outermost fins 3. Side tank 4 is provided on a side of heat exchanger body 1, specifically, on the outer surface of side plate 12, for forming fluid introduction/discharge paths 4*a* and 4*b*. Fluid path block 5 is provided on side tank 4. Fluid introducing port 5*a* and fluid discharging port 5*b* are provided on fluid path block 5.

Figure 2:
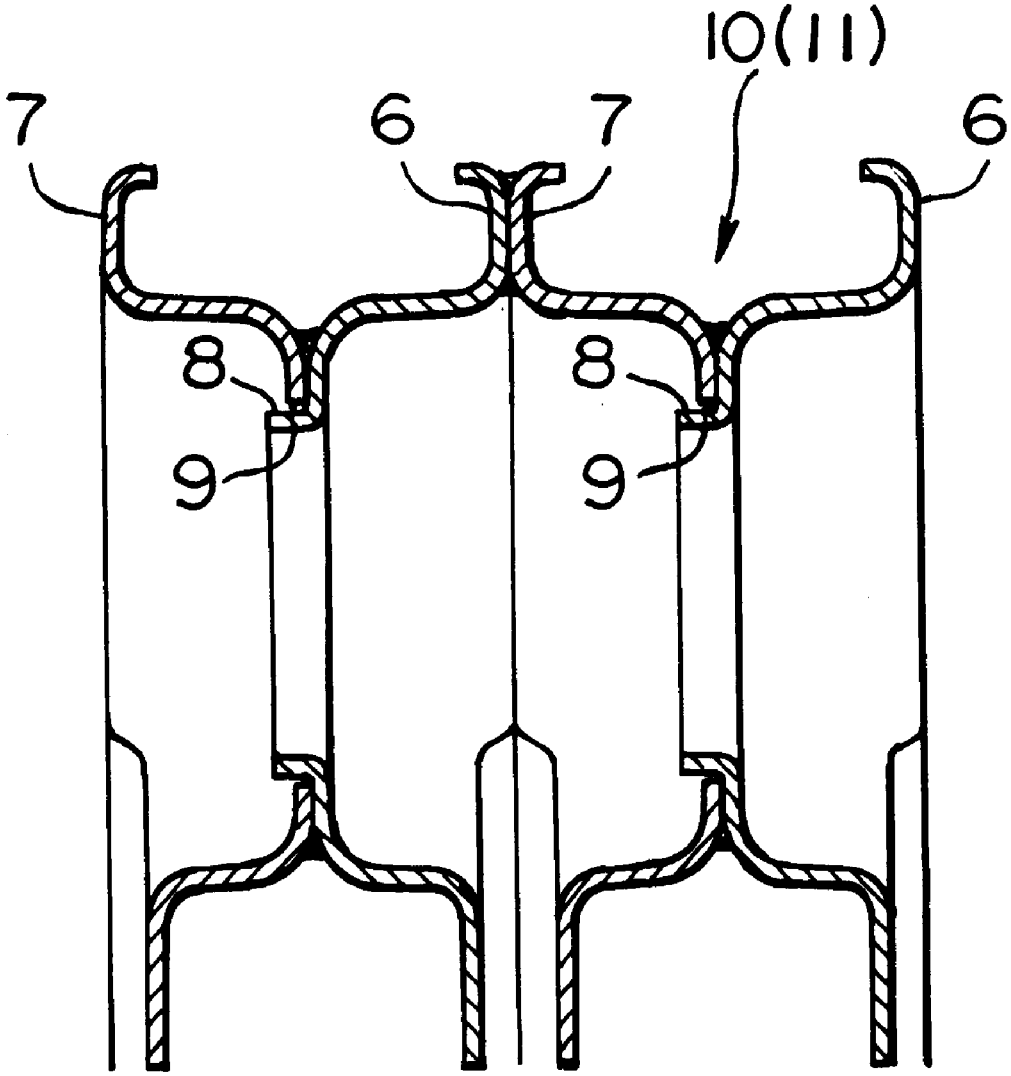
FIG. 2 is a partial cross-sectional view of a header tank of a heat exchanger body of the heat exchanger depicted in FIG. 1.

Each heat transfer tube 2 is formed by connecting tube forming plates 6 and 7 to each other, as depicted in FIG. 2. Projecting portions 8 are provided on both longitudinal end portions of one side of tube forming plate 6. Each projecting portion 8 is inserted into a hole 9 defined on adjacent tube forming plate 7, and each tube forming plate 6 is connected to adjacent tube forming plate 7 by brazing. Thus, header tanks 10 (10*a*, 10*b*) and 11 (11*a*, 11*b*) are formed on both longitudinal end portions of arranged heat transfer tubes 2. Heat exchanger core 1*a* is formed as a portion between header tanks 10 and 11.

Figure 3:
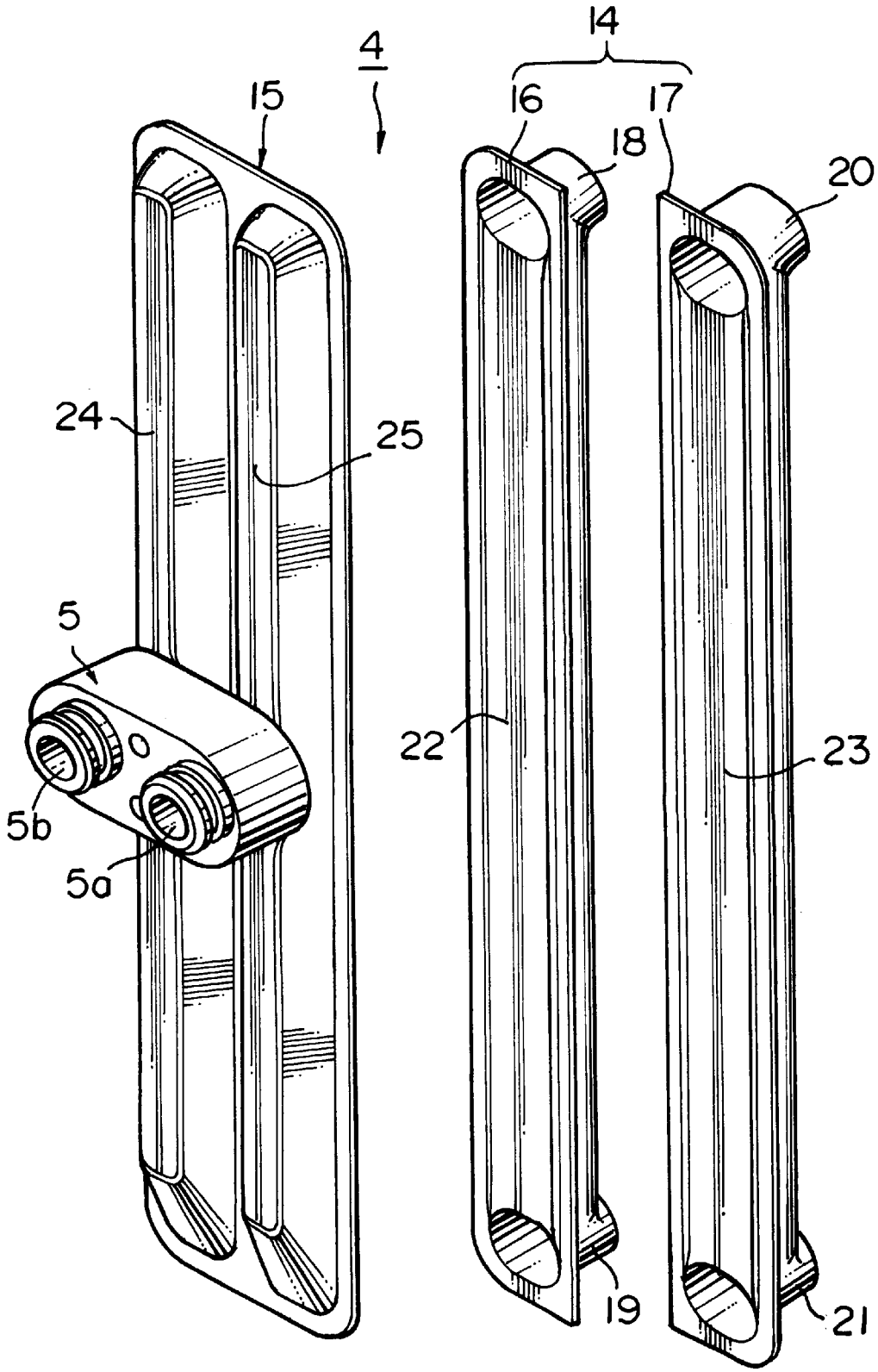
FIG. 3 is an exploded perspective view of a side tank of the heat exchanger depicted in FIG. 1.
Figure 4:
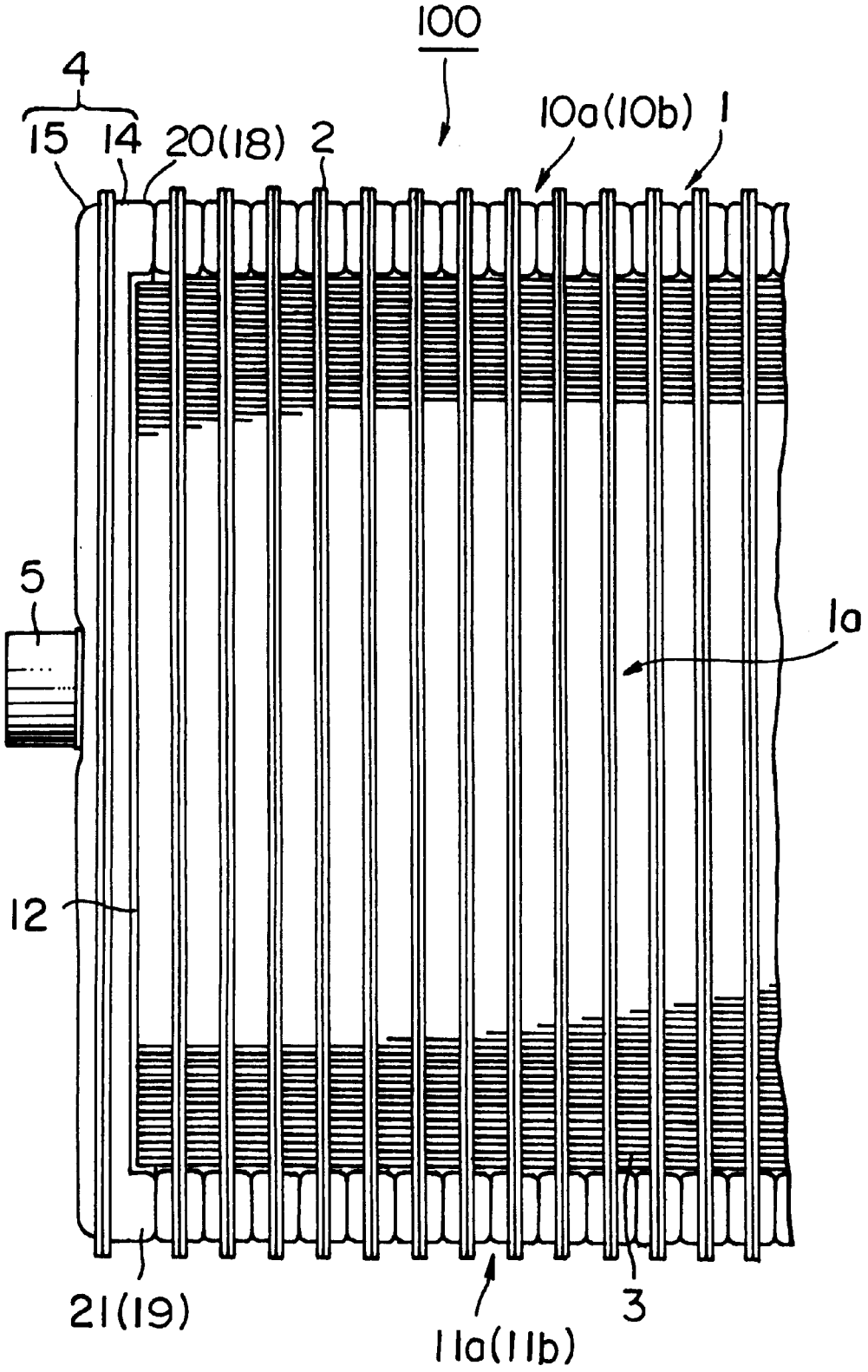
FIG. 4 is a partial elevational view of the heat exchanger depicted in FIG. 1.

Side tank 4 is formed as depicted in FIG. 3. First side tank forming plate 14 is provided at a heat exchanger body side of side tank 4. Second side tank forming plate 15 is provided at a non-heat exchanger body side of side tank 4. First and second side tank forming plates 14 and 15 are connected to each other to form side tank 4. In this embodiment, first side tank forming plate 14 is divided into two parts comprising two plates 16 and 17, in the thickness direction of heat exchanger core 1*a* of heat exchanger body 1. On both ends of respective plates 16 and 17, drawn projecting portions 18, 19, 20 and 21 are formed to project toward corresponding header tanks 10*b*, 11*b*, 10*a* and 11*a*. Drawn projecting portions 18, 19, 20 and 21 are connected directly to corresponding header tanks 10*b*, 11*b*, 10*a* and 11*a* to form respective fluid paths communicating between fluid introduction and discharge paths 4*a* and 4*b* and respective header tanks 10*b*, 11*b*, 10*a* and 11*a*, as depicted in FIG. 4. Further, in this embodiment, protruding portions 22 and 23, protruding toward heat exchanger body 1, are formed on divided plates 16 and 17, respectively. Protruding portions 22 and 23 extend in the longitudinal direction of first side tank forming plate 14 to form fluid introduction and discharge paths 4*a* and 4*b* in side tank 4.

Second side tank forming plate 15 is formed from a single plate in this embodiment. Protruding portions 24 and 25, protruding in a direction opposite to the direction toward heat exchanger body 1, are formed on second side tank forming plate 15. First side tank forming plate 14 and second side tank forming plate 15 thus formed are connected to each other to form side tank 4. Protruding portion 22 and protruding portion 24 cooperatively form fluid discharge path 4*b*. Protruding portion 23 and protruding portion 25 cooperatively form fluid introduction path 4*a*.

In this embodiment, first side tank forming plate 14 is divided into two parts of plates 16 and 17 in the thickness direction of heat exchanger core 1*a*. When drawn projecting portions 18, 19, or 20, 21 are formed on plate 16 or 17, an excessive amount of drawing does not generate in a particular portion between plates 16 and 17, because plates 16 and 17 are separated from each other. Moreover, when protruding portions 22 and 23 are formed on plates 16 and 17, a too thin portion does not generate on a particular portion on respective plates 16 and 17. Therefore, occurrence of defects, such as cracks or too thin portions caused by a concentration of a processing force to particular portions, may be prevented by the two-part divided structure of first side tank forming plate 14. Consequently, an optimum fluid path having a great sectional area may be formed in side tank 4, thereby reducing the pressure loss of heat exchanger 100. Further, a leak-tight condition may be ensured by the crackless structure of side tank 4. Thus, a high-performance heat exchanger may be achieved.

Figure 5:
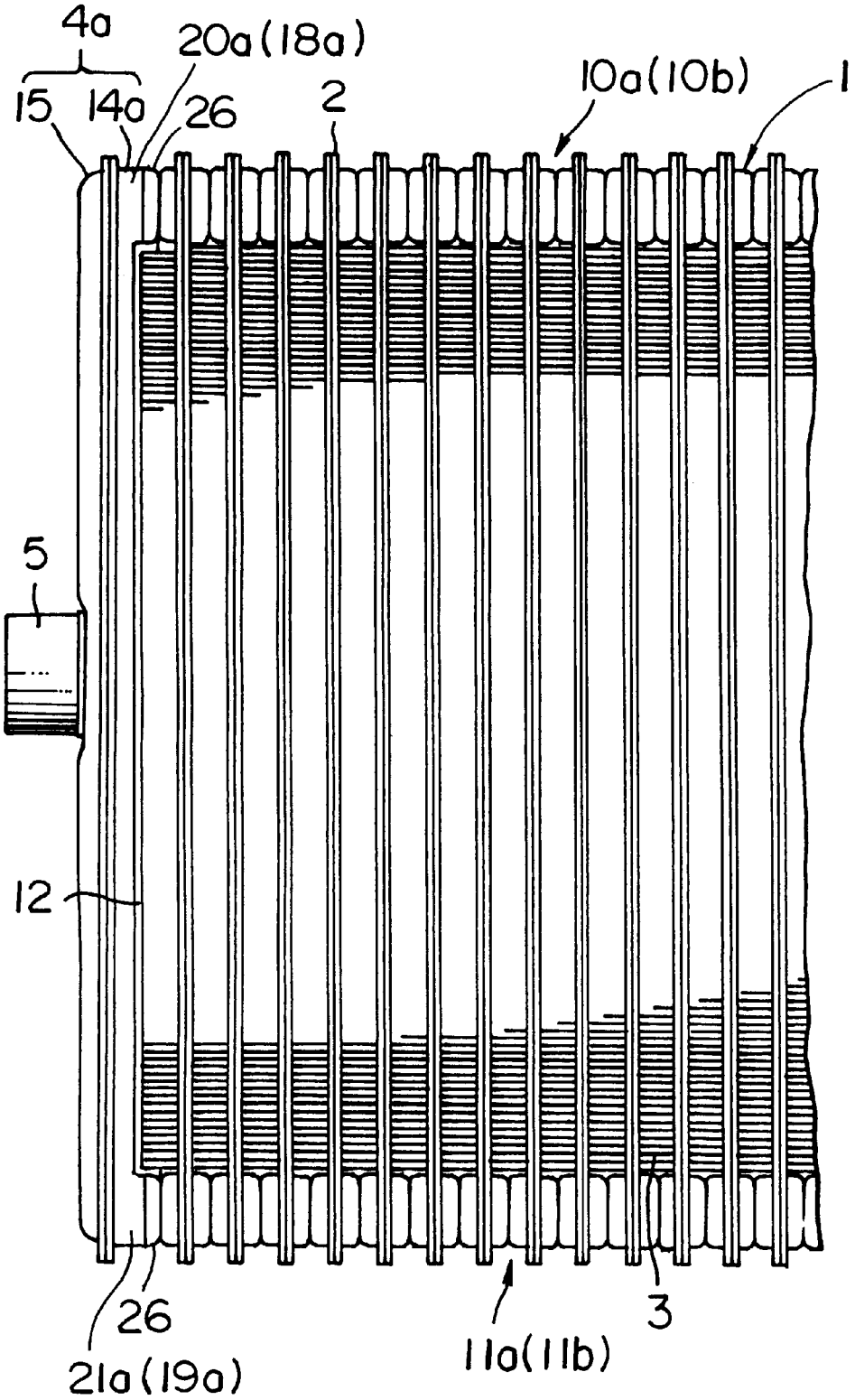
FIG. 5 is a partial elevational view of a heat exchanger according to a second embodiment of the present invention.

FIG. 5 depicts a heat exchanger according to a second embodiment of the present invention. In this embodiment, drawn projecting portions 18*a*, 19*a*, 20*a* and 21*a* of first side tank forming plate 14*a* of side tank 4*a* are connected to corresponding header tanks 10*b*, 11*b*, 10*a* and 11*a* via interposed auxiliary connecting members 26. In such a structure, the amount of drawing for each drawn projecting portion 18*a*, 19*a*, 20*a* or 21*a* may be reduced, or it may be possible to omit to form drawn projecting portions, thereby preventing the generation of cracks or too thin portions more effectively.

Figure 6:
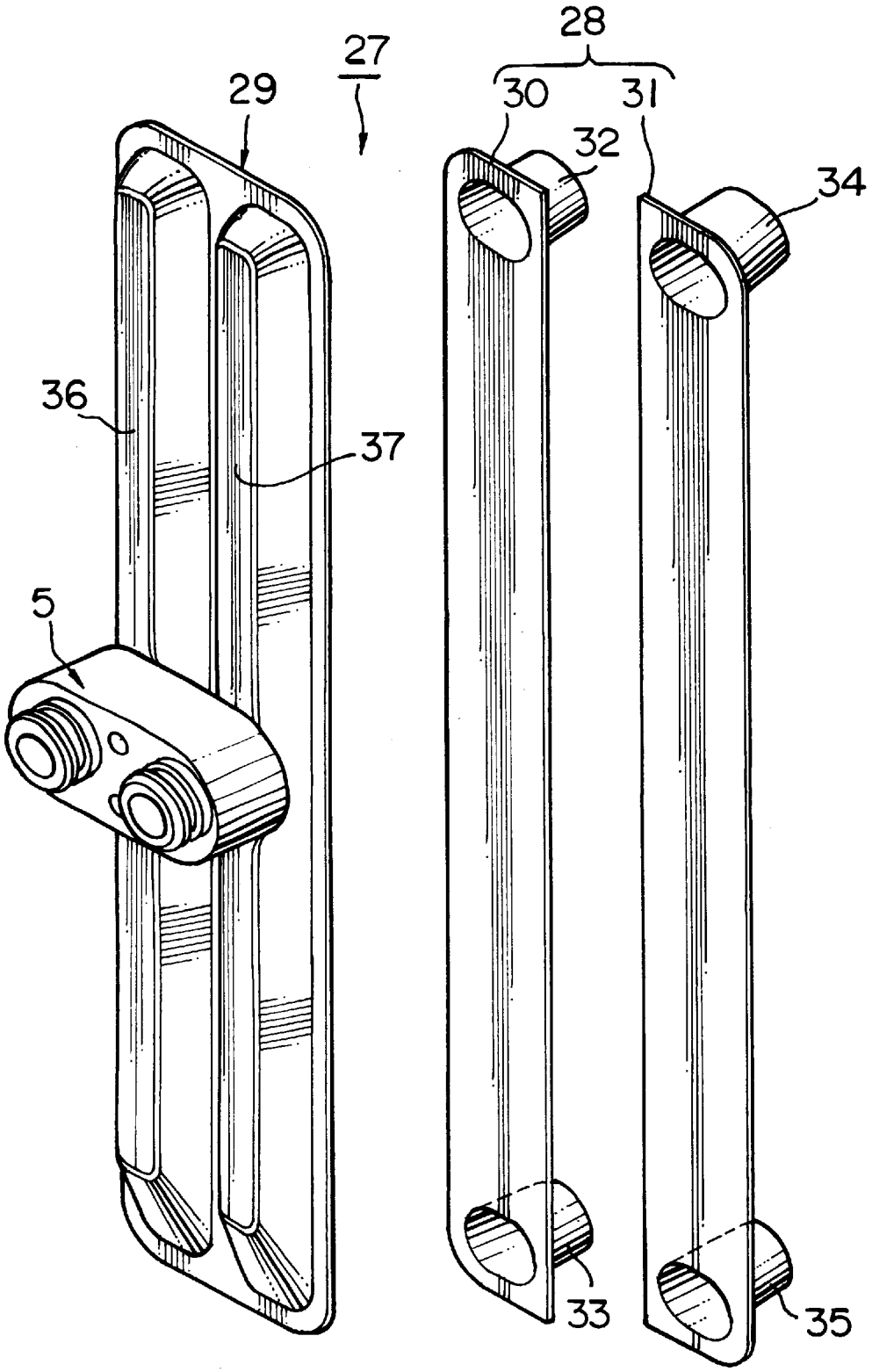
FIG. 6 is an exploded perspective view of a side tank of a heat exchanger according to a third embodiment of the present invention.

FIG. 6 depicts a side tank of a heat exchanger according to a third embodiment of the present invention. Side tank 27 is formed by connecting first side tank forming plate 28, which is provided at a heat exchanger body side, and second side tank forming plate 29 to each other. First side tank forming plate 28 is divided into two plates 30 and 31 in the thickness direction of a heat exchanger core. In this embodiment, drawn projecting portions 32, 33, 34 and 35 are provided on plates 30 and 31, but protruding portions are not provided on plates 30 and 31. On second side tank forming plate 29, protruding portions 36 and 37 are formed for forming fluid introduction/discharge paths in side tank 27.

Also in such a structure, because first side tank forming plate 28 is divided into two parts in the thickness direction of a heat exchanger core, when first side tank forming plate 28 is processed, the generation of cracks or too thin portions may be prevented. A leak-tight condition may be ensured by the crackless structure of side tank 27, thereby achieving a high-performance heat exchanger.

Figure 7:
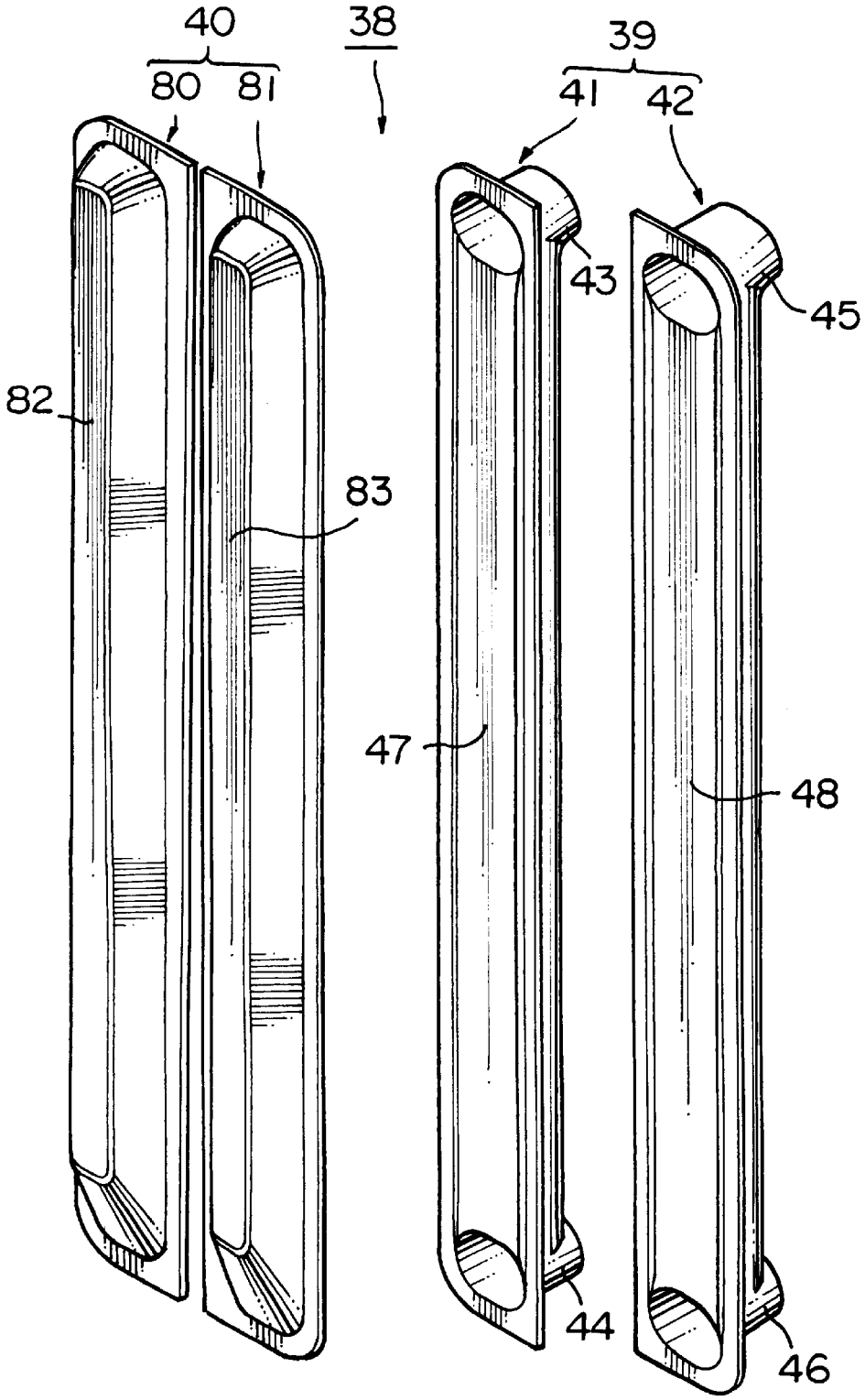
FIG. 7 is an exploded perspective view of a side tank of a heat exchanger according to a fourth embodiment of the present invention.

FIG. 7 depicts a side tank of a heat exchanger according to a fourth embodiment of the present invention. Side tank 38 is formed by connecting first side tank forming plate 39, which is provided at a heat exchanger body side, and second side tank forming plate 40 to each other. First side tank forming plate 39 is divided into two plates 41 and 42 in the thickness direction of a heat exchanger core. Drawn projecting portions 43, 44, 45 and 46, and protruding portions 47 and 48, are provided on plates 41 and 42. In this embodiment, second side tank forming plate 40 also is divided into two plates 80 and 81 in the thickness direction of the heat exchanger core. Protruding portions 82 and 83 are formed on divided plates 80 and 81, respectively, for forming fluid introduction/discharge paths in side tank 38.

In such a structure, because second side tank forming plate 40 also is divided into two parts in the thickness direction of a heat exchanger core, when second side tank forming plate 40 is processed, the generation of cracks or too thin portions may be prevented. A leak-tight condition may be ensured by the crackless structure of side tank 38. Moreover, because protruding portions 47, 48, 82 and 83 are formed on both first and second side tank forming plates 39 and 40, fluid introduction/discharge paths having great cross-sectional areas may be easily formed in side tank without generating any defects, thereby reducing the pressure loss in side tank 38 more greatly.

Figure 8:
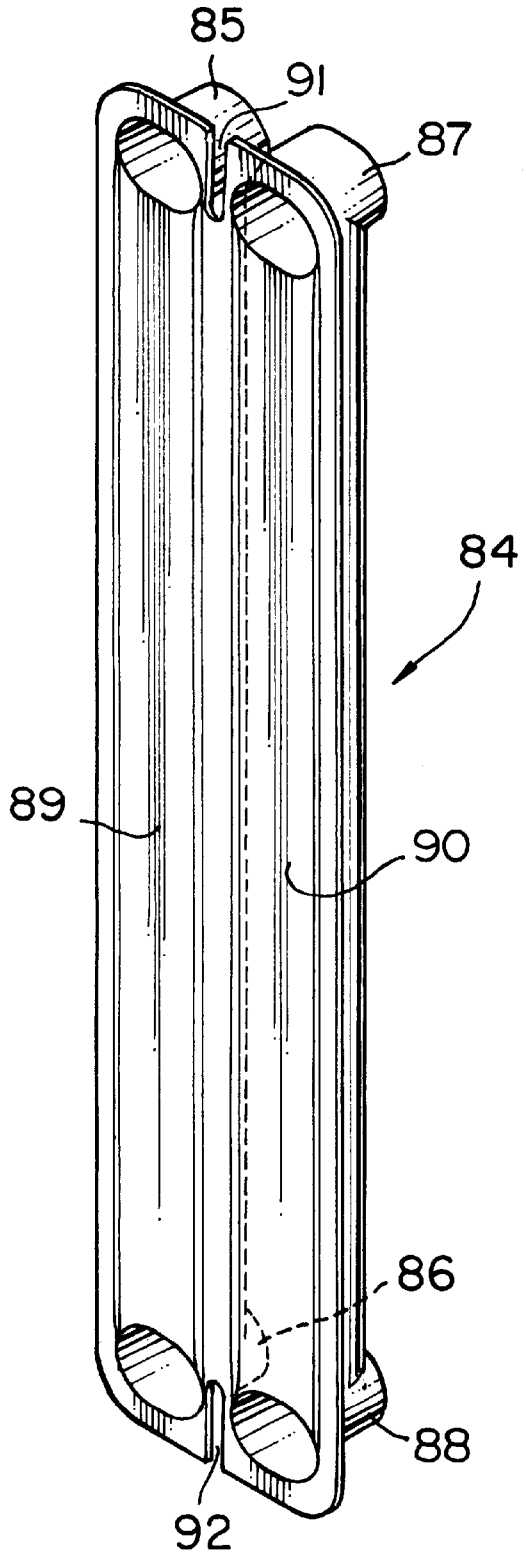
FIG. 8 is a perspective view of a first side tank forming plate of a side tank of a heat exchanger according to a fifth embodiment of the present invention.
Figure 9:
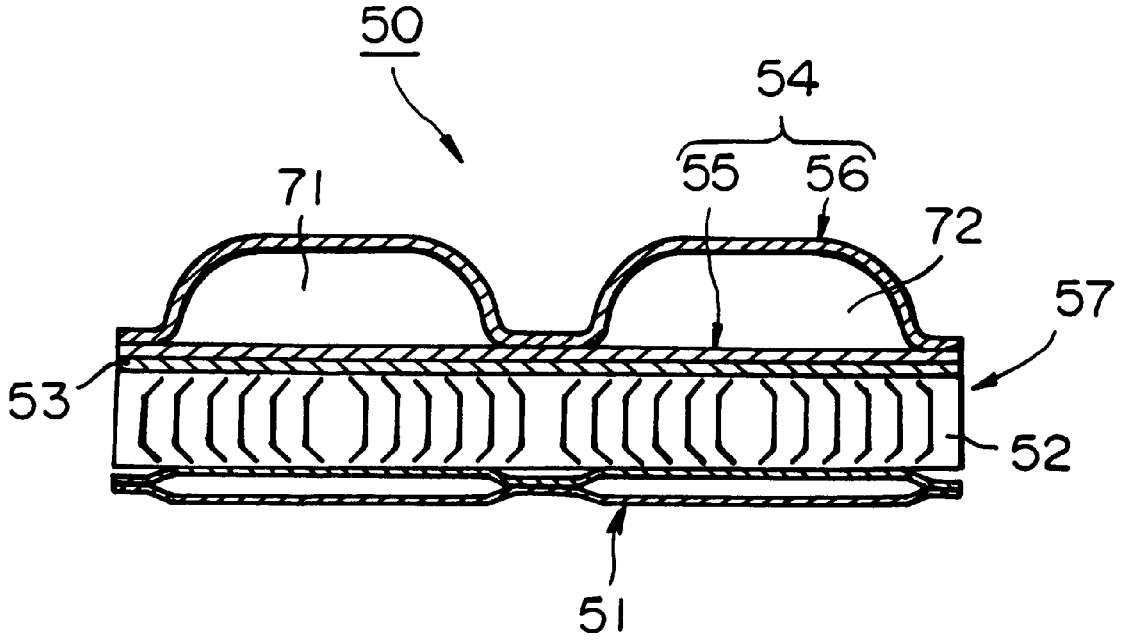
FIG. 9 PRIOR ART
FIG. 9 is a cross-sectional view of a side tank portion of a known heat exchanger.
Figure 10:
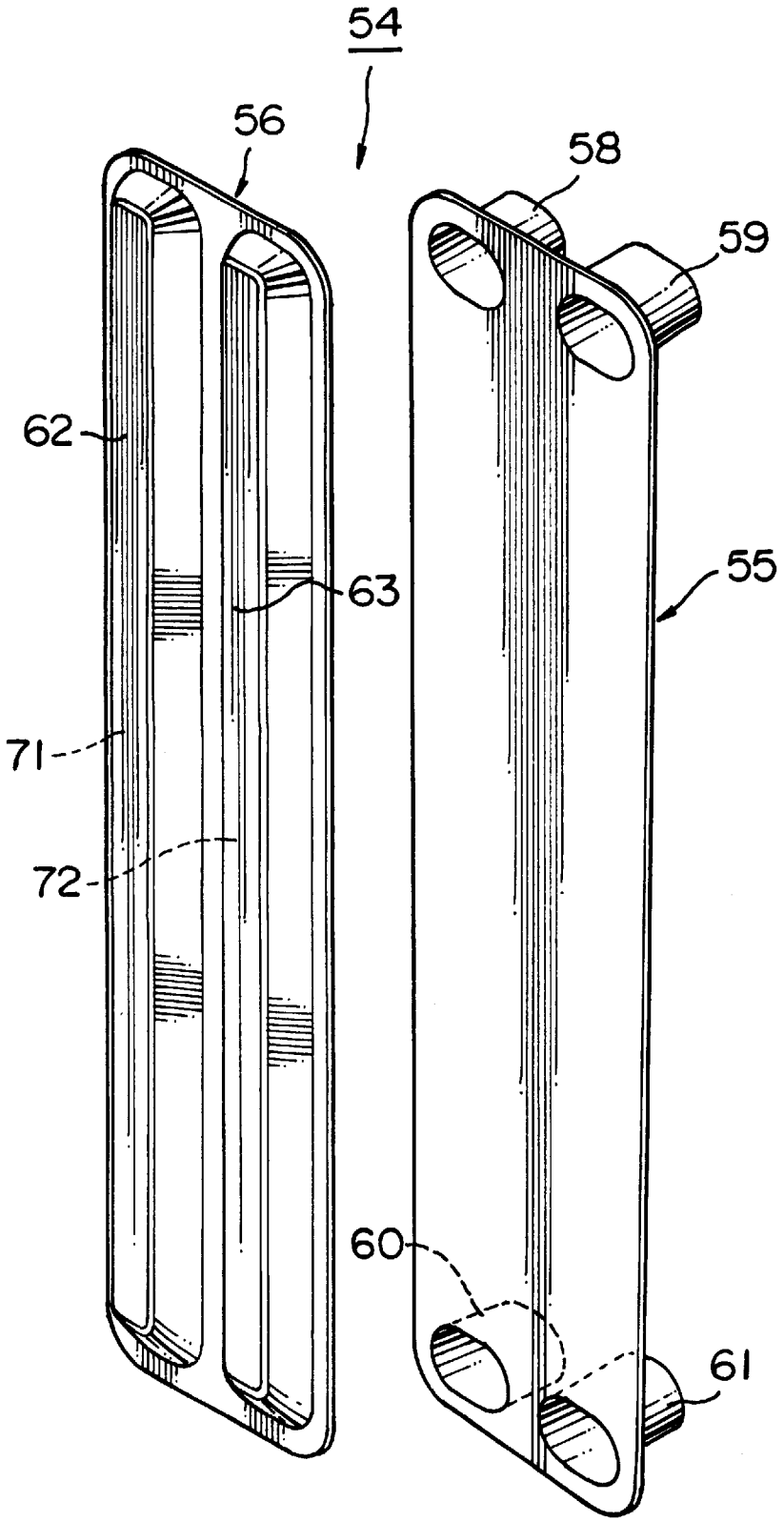
FIG. 10 PRIOR ART
FIG. 10 is an exploded perspective view of the side tank depicted in FIG. 9.
Figure 11:
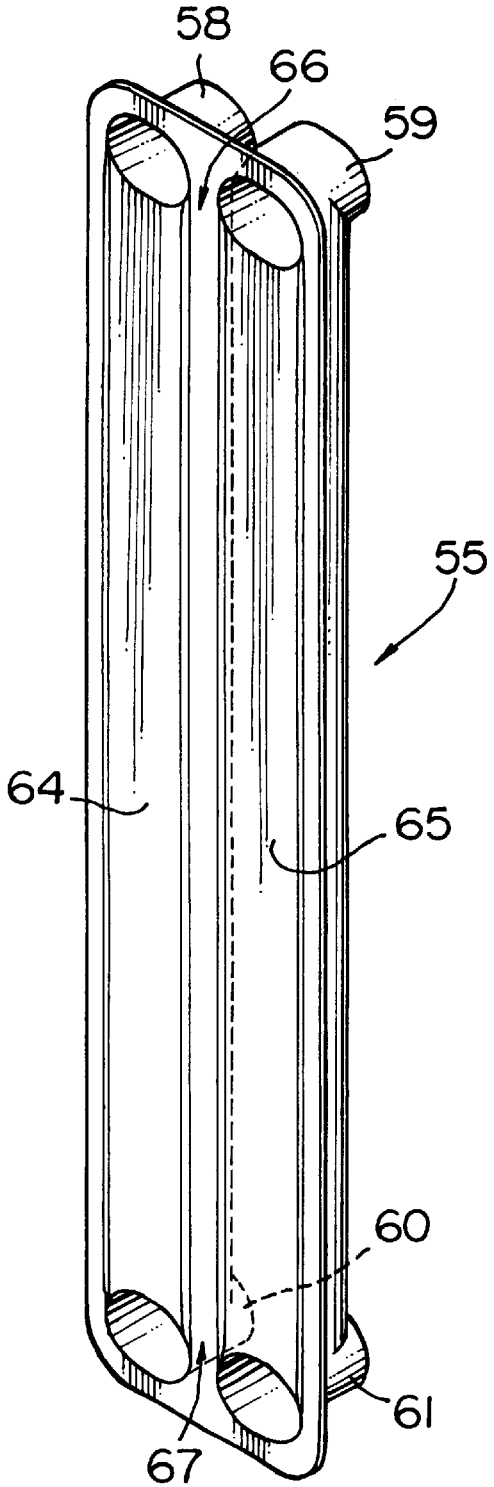
FIG. 11 PRIOR ART
FIG. 11 is a perspective view of a first side tank forming plate of a side tank of another known heat exchanger.
Figure 12:
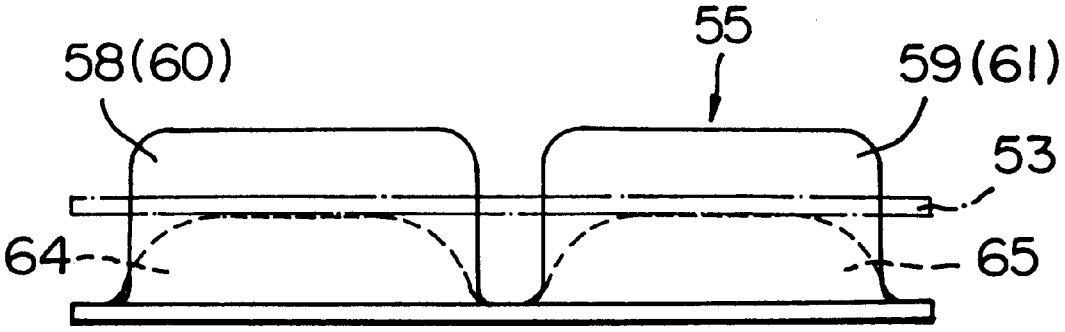
FIG. 12 PRIOR ART
FIG. 12 is a plan view of the first side tank forming plate depicted in FIG. 11.

FIG. 8 depicts a first side tank forming plate of a side tank of a heat exchanger according to a fifth embodiment of the present invention. In this embodiment, slots 91 and 92 are provided on the respective longitudinal end portions of first side tank forming plate 84 at the central portions of first side tank forming plate 84 in a thickness direction of a heat exchanger core. Slot 91 is defined between drawn projecting portions 85 and 87. Protruding portions 89 and 90 are provided. Slot 91 extends from the edge of first side tank forming plate 84 toward the inside of first side tank forming plate 84 along the longitudinal direction of first side tank forming plate 84, at a position near drawn projecting portions 85 and 87. Similarly, slot 92 is defined between drawn projecting portions 86 and 88. Slot 92 extends from the other edge of first side tank forming plate 84 toward the inside of first side tank forming plate 84 along the longitudinal direction of first side tank forming plate 84, at a position near drawn projecting portions 86 and 88. With respect to a second side tank forming plate, any plate described in the first, second, third and fourth embodiments may be used.

In such a structure, because slots 91 and 92 are provided between drawn projecting portions 85 and 87 and between drawn projecting portions 86 and 88, an excessive processing force may be prevented from being transmitted to or concentrated in these portions, and the force may be released at the slot portions. Therefore, the generation of cracks or too thin portions may be prevented. Consequently, drawn projecting portions 85, 86, 87 and 88 having a desired configuration for achieving a high-performance heat exchanger may be easily formed on first side tank forming plate 84.

Although several embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A heat exchanger including a heat exchanger body having a heat exchanger core and header tanks, and a side tank provided at a side of said heat exchanger body for forming fluid introduction/discharge paths communicating with said header tanks, said side tank comprising:

a first side tank forming plate provided at a heat exchanger body side of said side tank, and second side tank forming plate provided at a non-heat exchanger body side of said side tank, said first and second side tank forming plates being connected to each other for forming said side tank, said first side tank forming plate being divided into two separate parts in a thickness direction of said heat exchanger core.

2. The heat exchanger of claim 1, wherein said second side tank forming plate is divided into two separate parts.

3. The heat exchanger of claim 1, wherein at least one drawn projecting portion, projecting toward one of said header tanks, is provided on said first side tank forming plate for forming a fluid path communicating between one of said fluid introduction/discharge paths and one of said header tanks.

4. The heat exchanger of claim 3, wherein said drawn projecting portion is connected directly to said one of said header tanks.

5. The heat exchanger of claim 3, wherein said drawn projecting portion is connected to said one of said header tanks via an auxiliary connecting member.

6. The heat exchanger of claim 1, wherein said fluid introduction/discharge paths extend in said side tank in a longitudinal direction of said side tank.

7. The heat exchanger of claim 6, wherein a protruding portion is formed on said first side tank forming plate for forming at least one of said fluid introduction/discharge paths, and said protruding portion protrudes toward said heat exchanger body, and extends in a longitudinal direction of said first side tank forming plate.

8. The heat exchanger of claim 1, wherein said second side tank forming plate is divided into two seperate parts.

* * * * *